US012209367B2

(12) United States Patent
Bacher et al.

(10) Patent No.: US 12,209,367 B2
(45) Date of Patent: Jan. 28, 2025

(54) RIDING SURFACE AND METHOD FOR CONSTRUCTING A RIDING SURFACE

(71) Applicant: Wolfgang Bacher, Lampertheim (DE)

(72) Inventors: Wolfgang Bacher, Lampertheim (DE); Robert Hoefler, Tuchenbach (DE)

(73) Assignee: WOLFGANG BACHER, Lampertheim (DE)

( * ) Notice: Subject to any disclaimer, the term of this patent is extended or adjusted under 35 U.S.C. 154(b) by 0 days.

(21) Appl. No.: 17/556,005

(22) Filed: Dec. 20, 2021

(65) Prior Publication Data

US 2022/0112667 A1 Apr. 14, 2022

Related U.S. Application Data

(63) Continuation of application No. 16/482,130, filed as application No. PCT/DE2017/200140 on Dec. 28, 2017, now abandoned.

(30) Foreign Application Priority Data

| | | |
|---|---|---|
| Jan. 31, 2017 | (DE) | 10 2017 201 564.0 |
| Feb. 13, 2017 | (DE) | 10 2017 202 251.5 |
| Jul. 26, 2017 | (DE) | 10 2017 212 824.0 |

(51) Int. Cl.

| | |
|---|---|
| ***E01C 13/02*** | (2006.01) |
| ***E01C 3/00*** | (2006.01) |
| ***E01C 13/06*** | (2006.01) |

(52) U.S. Cl.

CPC ..... *E01C 13/06* (2013.01); *E01C 3/006* (2013.01); *E01C 13/02* (2013.01)

(58) Field of Classification Search

CPC .... A01G 25/023; A01G 25/06; Y02A 40/237; E01C 3/006; E01C 13/02; E01C 13/06

See application file for complete search history.

(56) References Cited

U.S. PATENT DOCUMENTS

| | | | | |
|---|---|---|---|---|
| 770,888 | A | 9/1904 | Benjamin | |
| 4,489,115 | A * | 12/1984 | Layman | E01C 13/08 428/17 |
| 4,887,800 | A | 12/1989 | Hotta et al. | |
| 5,938,372 | A | 8/1999 | Lichfield | |
| 7,993,729 | B2 * | 8/2011 | Wise | E01C 13/08 428/17 |
| 8,770,888 | B2 | 7/2014 | Helbig et al. | |

(Continued)

FOREIGN PATENT DOCUMENTS

| | | | |
|---|---|---|---|
| BE | 1011763 | A3 | 12/1999 |
| CN | 106149510 | A | 11/2016 |
| DE | 09405829 | U1 | 6/1994 |

(Continued)

OTHER PUBLICATIONS

EHG Reitplatzbau; Riding Arena Construction; Apr. 6, 2016; all (Year: 2016).*

(Continued)

*Primary Examiner* — Benjamin F Fiorello
(74) *Attorney, Agent, or Firm* — Brooks Kushman P.C.

(57) ABSTRACT

A riding surface, having a stepping layer and a mat arranged between the ground and the stepping layer, drip tubes for watering the stepping layer being embedded in the mat, preferably in grooves on the side of the mat facing the stepping layer.

5 Claims, 4 Drawing Sheets

(56) References Cited

U.S. PATENT DOCUMENTS

| | | | |
|---|---|---|---|
| 2003/0056432 | A1 | 3/2003 | Prevost |
| 2007/0144065 | A1 | 6/2007 | Lowe |

FOREIGN PATENT DOCUMENTS

| | | | |
|---|---|---|---|
| DE | 4416943 | A1 | 12/1995 |
| DE | 102005023413 | A1 | 11/2006 |
| DE | 102006052286 | A1 | 2/2008 |
| DE | 202008006572 | U1 | 8/2008 |
| DE | 202014001564 | U1 | 6/2014 |
| EP | 2599916 | B1 | 11/2015 |
| EP | 2804469 | B1 | 7/2020 |
| JP | H09203007 | A | 8/1997 |
| JP | 2005348669 | A | 12/2005 |
| JP | 3139880 | U | 3/2008 |
| JP | 201285549 | A | 5/2012 |
| JP | 2012085549 | A | 5/2012 |
| JP | 2016196761 | A | 11/2016 |
| RU | 2465767 | C2 | 11/2012 |
| SU | 1308280 | A1 | 5/1987 |
| WO | 0062603 | A2 | 10/2000 |
| WO | 2009075587 | A1 | 6/2009 |
| WO | 2010062549 | A2 | 6/2010 |
| WO | 2013107954 | A1 | 7/2013 |
| WO | 2018141321 | A1 | 8/2018 |

OTHER PUBLICATIONS

ISR for PCT/DE2017/200140, Prepared by the European Patent Office, mailing date Mar. 21, 2018, 6 pages Including translation.

* cited by examiner

RIDING SURFACE AND METHOD FOR CONSTRUCTING A RIDING SURFACE

CROSS-REFERENCE TO RELATED APPLICATIONS

This application is a continuation of U.S. application Ser. No. 16/482,130 filed Jul. 30, 2019, which, is the U.S. national phase of PCT Application No. PCT/DE2017/200140 filed on Dec. 28, 2017, which claims priority to DE Patent Application No. 10 2017 201 564.0 filed on Jan. 31, 2017, DE Patent Application No. 10 2017 202 251.5 filed on Feb. 13, 2017, and DE Patent Application No. 10 2017 212 824.0 filed on Jul. 26, 2017 the disclosures of which are incorporated in their entirety by reference herein.

TECHNICAL FIELD

The present invention relates to an irrigable riding surface as well as to a method for constructing the same.

BACKGROUND

Riding surfaces and systems for irrigating riding surfaces are known in practice in the most diverse embodiments, for both the open-air riding ground as well as indoor riding arenas. In particular, a multiplicity of surfaces and systems, inter alia having so-called underground irrigation, which are intended to ensure a uniform penetration of moisture of the area are known. Drip tubes or hoses, respectively, and ground grids thereabove for protecting the drip hoses from damage by horses' hooves are installed on the usually native ground. The ground grids are typically constructed in a mesh-shaped manner such that the sand of the tread layer can be irrigated and optionally dewatered. To this end, the ground grids are filled with and completely covered by sand in order for a tread layer to be formed. By virtue of the physical properties of the sand, in particular by virtue of the capillary effect of the sand particles, moisture from the drip hoses is transported upward into the tread layer. By using such a riding surface having integrated moistening, the tread firmness underfoot is enhanced while largely eliminating the risk of the horse slipping. Furthermore, the time for separate moistening of the surface is saved. Textile or non-woven shreds are typically added to the sand in order for the surface to be loosened.

A significant problem of riding surfaces known in practice lies in that the drip hoses are installed directly on the ground and a not insignificant part of the quantity of water does not moisten the tread layer but indeed rather seeps away, or runs off, respectively, into the ground. Furthermore, the clearances of the in most instances thick and open ground grids for irrigating and dewatering the riding surfaces are extremely large. Since the sand, besides aggregates, of the tread layer also has to be filled into the ground grid, an extremely large quantity of sand is required. In other words, the volume of the known ground grids to be filled with sand is extremely large. This increases the quantity of sand required. A further disadvantage of the known riding surfaces lies in the construction thereof that is rather complex in production, in particular in the case of an embodiment having a large area. Moreover, the handling when storing, when constructing, and when transporting the riding surface is rather complex, depending on the size and area, respectively. A further disadvantage lies in that corresponding additives, for example in the form of textile or non-woven shreds, are required in most instances for achieving a shock-absorbing surface or suitable damping that is gentle to the horses, respectively, but said additives in terms of the effect are inadequate on their own.

SUMMARY

The present invention is therefore based on the object of providing a riding surface which, while having a robust and simple construction and largely eliminating the risk of injury to the horse, guarantees optimal irrigating and dewatering. Moreover, an improved method for constructing a corresponding riding surface is to be specified.

The above object in terms of the riding surface is achieved by the features of the present invention. Accordingly, the riding surface has a tread layer, a mat that is disposed between the ground and the tread layer, and drip hoses, wherein the drip hoses are embedded in the mat, preferably in grooves on that side of the mat that faces the tread layer.

In terms of the method according to the invention, the underlying object is achieved in that the drip hoses are embedded, preferably on site, in the mat, preferably in grooves on that side of the mat that faces the tread layer.

It has been recognized according to the invention that it is particularly advantageous for the drip hoses not to be disposed on the ground and protected by voluminous ground grids which are complex in terms of the construction thereof and in turn have to be filled with a large volume of sand and damping additives in order for the ground grids to be filled and covered. Entirely opposed thereto, the invention follows an entirely different path in that a mat is placed directly or indirectly on the ground, and the drip hoses are disposed on that side of the mat that faces the tread layer. Specifically, the drip hoses can be embedded in grooves on that side of the mat that faces the tread layer. On account of the grooves, the drip hoses are fixedly disposed on the mat and largely protected against damage, and any unwanted seepage of the water making its way out of the drip hoses is simultaneously avoidable. The drip hoses can be assigned to the mat by way of a press-fit, for example. It can be necessary herein for the drip hoses to be embedded or jammed, respectively, in the mat by stepping or lightly hammering on said drip hoses. A latching mechanism and/or embodiments similar to that of a tongue and/or groove connection are also conceivable. The tread layer thus bears directly or indirectly on the mat and the drip hoses. An extremely thin riding surface and a nevertheless robust structure can be implemented on account thereof. The required volume of the tread layer can be reduced to a minimum. Any potential risk of injury by virtue of excessively deep clearances of ground grids is also eliminated. The drip hoses, on account of being embedded in the grooves of the mat, have a fixed position and cannot readily slip out of position during the construction of the riding surface or over the course of time. A further advantage lies in that, by virtue of the simple construction, in particular by virtue of the predefined embedding of the drip hoses, the construction of the riding surface can in particular also be performed without any particular expert knowledge.

Consequently, a possibility to guaranteed optimal irrigating and dewatering while having a robust and simple construction and largely eliminating the risk of injury to the horse is specified by way of the riding surface according to the invention as well as by way of the method for constructing a riding surface according to the invention.

The mat at least in regions is advantageously produced from a water-permeable and/or soft and/or damping material. PU foam rubber which is preferably pressed under the influence of heat and/or baked is particularly suitable to this end. The use of rubber granules, in particular from recycled automobile tires, is likewise conceivable. The mat can be constructed so as to be largely solid, or can have a mesh structure. The configuration of the mat from a soft or damping, respectively, material is particularly conducive to the health of horses, or gentle for horses, respectively, and can save adding soft additives to the sand. A certain water permeability prevents any backlog of water and an excessive wetness of the riding surface. In the case of a largely inherently closed mat, the unwanted seepage of the water serving for moistening is avoided or at least reduced. Alternatively or additionally, the mat at least in regions is made from a firm material, preferably from PVC. An increased stability as well as an increased protection of the drip hoses is guaranteed on account thereof. The utilization of a firm material furthermore is associated with the advantage of a certain distribution of pressure. It is conceivable for the mat at least in regions, in particular in the region of the grooves to be produced from water-impermeable material, so as to largely avoid any unwanted seepage of the water exiting the drip hoses. The mat can be embodied so as to be extremely thin, specifically just so thin that protection, and optionally a distribution of pressure, is guaranteed.

Depending on the material and the production method of the mat, it is advantageous in terms of the storage, the transportation, and the handling for the mat to be providable as rolled goods. It is furthermore conceivable for individual mat elements to be capable of being snap-fitted to one another on site and/or are extendable in an arbitrary manner. The riding surface can thus be extended to arbitrary areas, specifically by lining up a plurality of mats and optionally intermediate mats. To this end, connecting regions for connecting in each case one further mat could be configured at the ends of the mat. Simply placing beside one another and/or overlapping a plurality of mats is likewise conceivable. A peripheral mat could be adapted by trimming. A thickness of the mat of 25 mm to 30 mm is already sufficient for embedding the drip hoses in the mat and for forming a stable and damping foundation for the tread layer. Extremely high floor structures, such as are known in practice in the construction of riding surfaces having ground grids, can be dispensed with.

It is furthermore advantageous for the grooves to be machined into the mat and/or be produced, in particular by injection-molding technology, when producing the mat. The width and the depth of the grooves herein can be adapted to the hoses used. The grooves for embedding the drip hoses preferably run at regular spacings and so as to be mutually parallel. Spacings of 30 cm between the drip hoses are conceivable.

In particular in the case of water-permeable mats, part of the water exiting the drip hoses can seep through the mat and remain unutilized for irrigation. In order for this to be avoided, at least that surface of the grooves that is oriented toward the tread layer is largely water-impermeable, in particular is coated with a water-impermeable material, and/or the grooves are configured in a water-impermeable mat or at least a water-impermeable region of the mat.

The mat at specific spacings particularly advantageously has passages, preferably holes, which permit a penetration by water and/or largely avoid any penetration of comparatively large quantities of sand and other particles. On account thereof, dewatering can be guaranteed, for example in the event of heavy rain, without losing water which emanates from the drip hoses. At the same time, ideally almost no sand seeps from the tread layer to below the mat. A round and/or square design embodiment of the passages is conceivable. It is conceivable herein that the passages are disposed in a linear manner and so as to be parallel to the grooves and have a specific spacing from the grooves such that water making its way from the drip hoses at least largely does not seep through the passages.

In order for any slippage of the sand of the tread layer to be avoided, it is particularly advantageous for the mat, at least on that side thereof that faces the tread layer, to have a structure, in particular a net or mesh structure. A corresponding structure of the surface of the mat can moreover again prevent that water exiting the drip hoses seeps through the passages, for example in that the grooves and the passages are disposed in different depressions, or at least in regions are mutually separated by elevations of a structure, respectively. It is important herein that the water making its way from the drip hoses does not directly seep away again by way of the passages but rather makes its way into the tread layer. The passages are intended to prevent that an excess quantity of water is situated in the tread layer and to discharge said excessive quantity to below the tread layer.

The drip hoses that are preferably produced from plastics material furthermore advantageously have valves and/or membranes that for irrigating the tread surface are oriented toward the tread layer. Said valves and/or membranes in the embedded state of the tread hoses thus lie so as to be oriented upward. An ideal transportation of the moisture toward the tread layer is implementable on account thereof. A diameter of the drip hoses of 16 mm is conceivable. The drip hoses are preferably disposed at regular spacings, for example so as to be mutually parallel.

For increased stabilizing and an increased protection of the tread hoses, as well as for distributing pressure, it is conceivable for an intermediate mat that is preferably produced from PVC and/or an intermediate net to be disposed between the mat and the tread layer. An intermediate mat, or an intermediate net, respectively, can advantageously have passages, preferably holes, at specific spacings. Said passages can permit a penetration of water from the drip hoses to the tread layer, but avoid any penetration of comparatively large quantities of sand and other particles from the tread layer to below the intermediate layer. A spacing between the individual passages and optionally membranes of an intermediate mat that is optimal for the irrigation of the tread layer is 10 cm. In order for any slippage of the sand of the tread layer to be avoided, it is conceivable for the intermediate mat, at least on that side thereof that faces the tread layer, to have a structure, in particular a net or mesh structure. The intermediate mat can be embodied so as to be extremely thin, specifically just so thin that protection, and optionally a distribution of pressure, is guaranteed.

It is furthermore conceivable for the mat to be disposed directly or indirectly on native ground and/or a drainage, in particular gravel. Despite the minor thickness thereof, the mat can be configured so as to be robust in such a manner that said mat also withstands a rough subsoil and even levels out certain ground unevenness.

It is furthermore conceivable for the mat to be disposed on native ground and/or a drainage, in particular gravel. Despite the minor thickness thereof, the mat can be configured so as to be robust in such a manner that said mat also withstands a rough subsoil and even levels out certain ground unevenness.

The tread layer is advantageously composed substantially of sand, besides aggregates, in particular of a geotextile product, and bears directly or indirectly on the mat and the drip hoses. Filling and covering a voluminous ground grid is not required here. The tread layer advantageously has a thickness of 10 to 12 cm so as to guarantee optimal moistening of the tread layer and a reduced risk of injury to horse and rider.

It is furthermore conceivable for a protective mat which is produced from a water-permeable and/or soft and/or damping material to be disposed below the mat. PU foam rubber which is preferably pressed under the influence of heat and/or baked is particularly suitable to this end. The use of rubber granules, in particular from recycled automobile tires, is likewise conceivable. The protective mat can be constructed so as to be largely solid, or can have a mesh structure. The configuration of the protective mat from a soft or damping, respectively, material is particularly conducive to the health of horses, or gentle for horses, respectively, and can save adding soft additives to the sand to a certain degree.

Constitutionally, it is conceivable for moisture sensors/probes which measure the moisture of the tread layer to be integrated in the riding surface, in particular in the tread layer. A control system can regulate the quantity and/or the time of the supply of water by way of the drip hoses.

The riding surface according to the invention as well as the method according to the invention for constructing such a riding surface is suitable for all fields of application including riding arenas, open-air riding grounds, and racetracks. Even superelevated curves, as in the case of racetracks, for example, are implementable using the riding surface according to the invention as well as the method according to the invention.

There are now various possibilities of advantageously designing and refining the teaching of the present invention. To this end, reference is to be made to the dependent claims of claim 1, on the one hand, and to the explanation hereunder of two preferred exemplary embodiments of the invention by means of the drawing, on the other hand. Preferred design embodiments and refinements of the teaching will also be explained in conjunction with the explanation of the preferred exemplary embodiments of the invention by means of the drawing.

DETAILED DESCRIPTION

Figure 1:
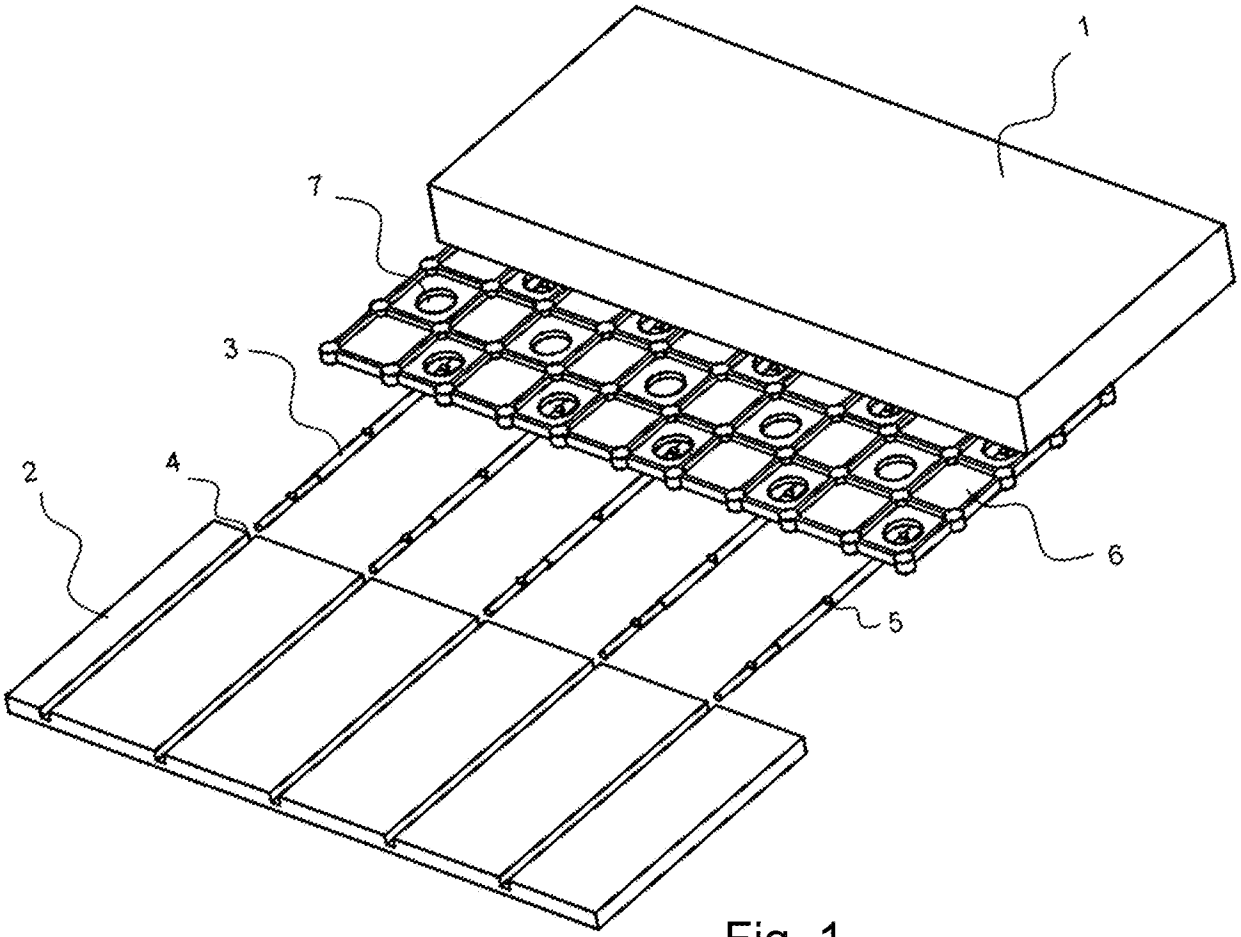
FIG. 1 in a schematic view shows a first exemplary embodiment of the construction of a riding surface according to the invention.

FIG. 1 in a schematic view shows a first exemplary embodiment of the construction of a riding surface according to the invention, having a tread layer 1, a mat 2 that is disposed between the ground and the tread layer 1, here referred to as lower mat 2, and drip hoses 3 which are embedded in grooves 4 of that side of the lower mat 2 that faces the tread layer 1.

The lower mat 2 is produced from a water-permeable, soft and damping material, specifically from PU foam rubber. The damping property of the mat 2 is very particularly conducive to the health of the horses moving on the riding surface. The production of the lower mat 2 from rubber granules from recycled automobile tires is also conceivable here. The lower mat 2 is providable as rolled goods, wherein the individual rolled webs of the lower mat 2 are capable of being snap-fitted to one another and are extendable in an arbitrary manner. The thickness of the lower mat 2 is approximately 25 to 30 mm. Said lower mat 2 is capable of being disposed on a preferably native ground and/or a drainage, for example gravel (not shown in FIG. 1). An optimal outflow of excess water is implementable on account of the water permeability of the lower mat 2. The soft and nevertheless stable material of the lower mat 2 offers an ideal ground for the riding surface, even on comparatively rough soil.

The drip hoses 3 are produced from plastics material and at regular spacings have valves 5 that for irrigating the tread surface are oriented toward the tread layer. The drip hoses can have a diameter of 16 mm and are embedded in parallel webs in the lower mat 2.

An intermediate mat 6, produced from PVC, is disposed above the lower mat 2 and the drip hoses 3 in order to stabilize and protect the dripping hoses 3 as well as for distributing pressure between the lower mat 2 and the tread layer 1. The intermediate mat 6 has a plurality of holes 7 that are disposed at a mutual spacing of 10 cm. Said holes 7 permit a penetration of water from below the intermediate mat 6 to the tread layer 1, however avoid any penetration of comparatively large quantities of sand and other particles from the tread layer 1 to below the intermediate mat 6. The intermediate mat 6 on that side of the intermediate mat 6 that faces the tread layer 1 has a mesh structure which avoids any slippage of the tread layer. An intermediate net instead of the intermediate mat 6 is also conceivable.

The tread layer 1 is composed substantially of sand, besides aggregates, specifically of a geotextile product, and bears on the intermediate mat 6. Said tread layer 1 has a thickness of 10 to 12 cm.

Figure 2:
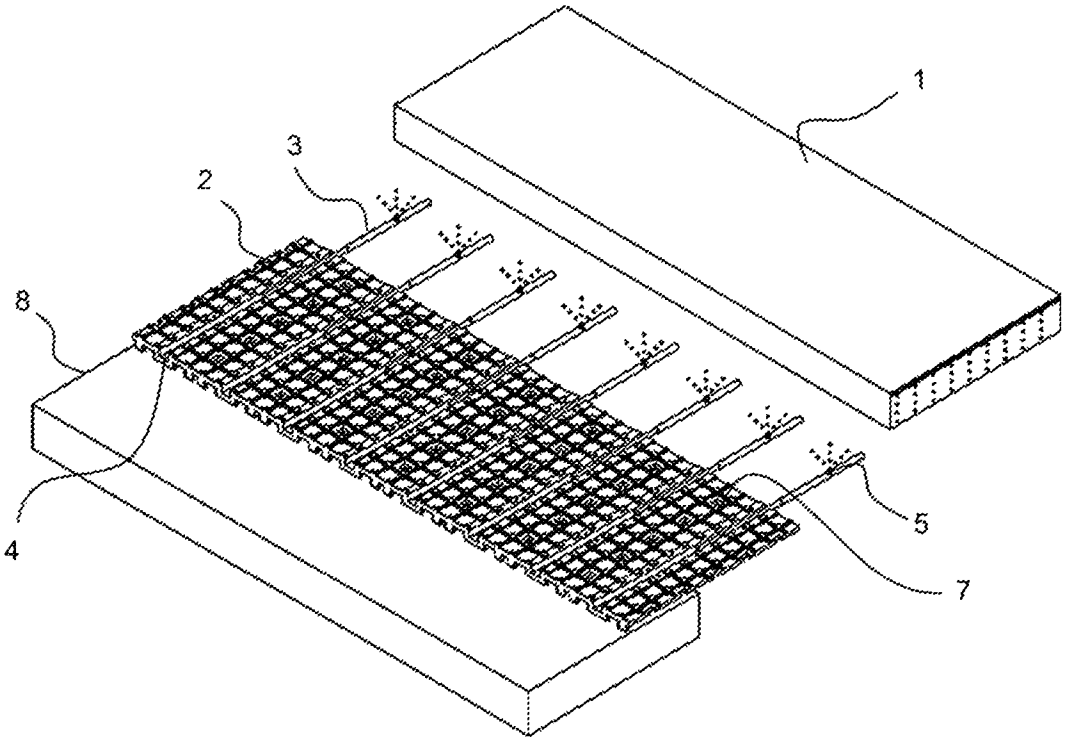
FIG. 2 in a schematic view shows a second exemplary embodiment of the construction of a riding surface according to the invention.
Figure 3:
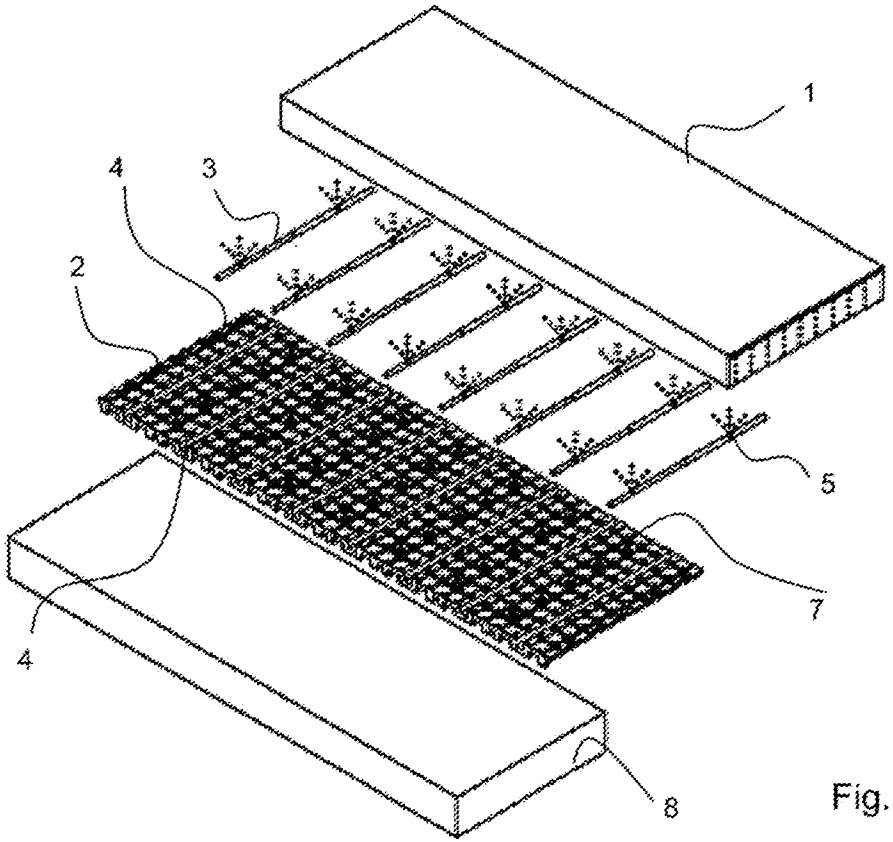
FIG. 3 in an exploded view shows the subject matter from FIG. 2.
Figure 4:
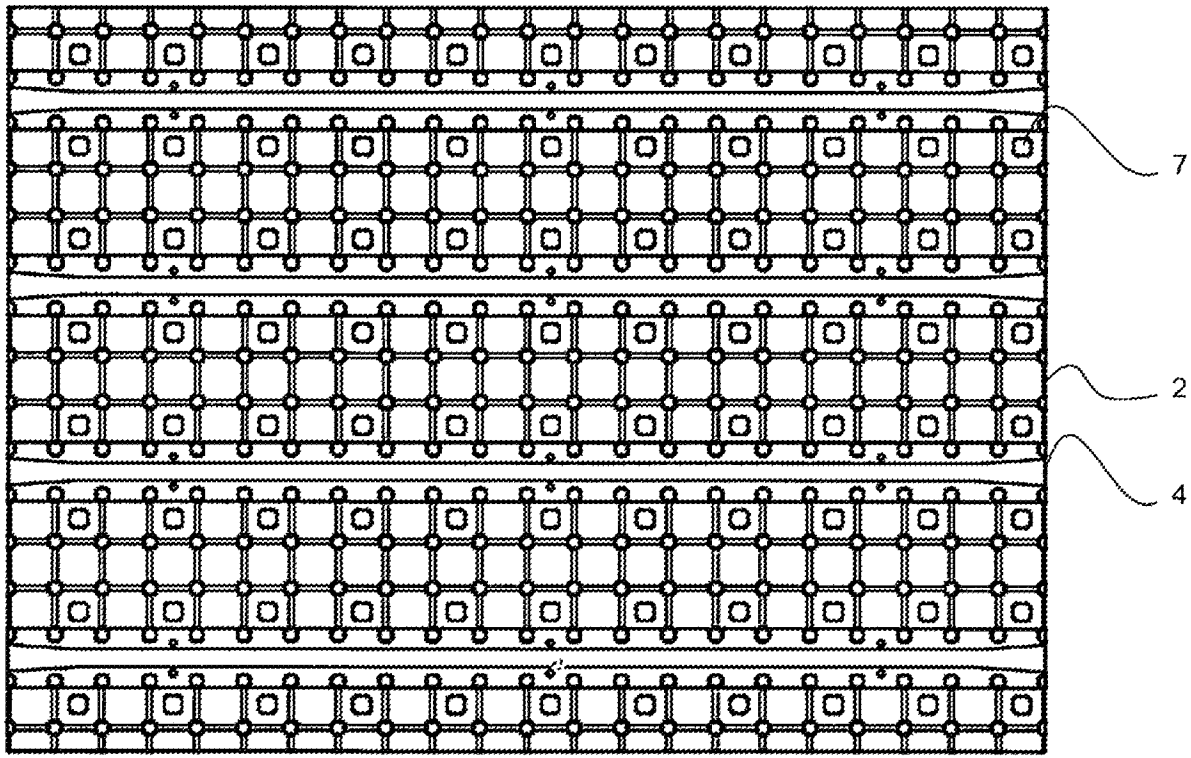
FIG. 4 shows a plan view of the mat from FIGS. 2 and 3.

FIGS. 2, 3, and 4 show in each case in a schematic view a second exemplary embodiment of a riding surface according to the invention, having a tread layer 1 and a mat 2 that in the sense of a separation mat is disposed between the ground 8 and the tread layer 1, wherein drip hoses 3 for irrigating the tread layer 1 are embedded in grooves 4 on that side of the mat 2 that faces the tread layer 1.

The mat 2 is produced from a firm material, specifically from PVC, and is capable of being snap-fitted from individual mat elements 2. The grooves 4 on that side of the mat 2 that faces the tread layer 1 are machined into the mat 2 and have a width as well as a depth of in each case 18 mm. The grooves 4 and thus the drip hoses 3 are disposed so as to be mutually parallel and at equal mutual spacings.

Square holes 7 which permit a penetration of water and largely avoid any penetration of comparatively large quantities of sand and other particles are provided between the drip hoses 3 in a linear manner and so as to be parallel to the drip hoses 3. The holes 7 are dimensioned to be just of such size that unwanted quantities of water in the tread layer, for example in the event of heavy rain, seep away, but not that quantity of water that for irrigating the tread layer exits the tread hoses 3.

The mat 2 on that side thereof that faces the tread layer 1 has a mesh structure which contributes toward the stability of the mat 2, on the one hand, and prevents that water exiting in an unwanted manner from the tread hoses 3 seeps away through the holes 7. In other words, the regions of the drip hoses 3 and those of the holes 7 are at least in part mutually separated by a mesh structure.

The drip hoses 3 are produced from plastics material and, for irrigating the tread layer 1, at regular spacings have valves 5 which are oriented toward the tread layer 1. The drip hoses are dimensioned in such a manner that said drip hoses are ideally capable of being embedded or jammed, respectively, in the grooves.

The mat 2 is disposed on native ground 8, specifically gravel. An optimal outflow of excess water is implementable on account of the water permeability of the mat 2.

The tread layer 1 is composed substantially of sand, besides aggregates, specifically of a geotextile product, and bears on the mat 2. Said tread layer 1 has a thickness of 10 to 12 cm.

In order to avoid repetitions, reference in terms of further advantageous design embodiments of the riding surface according to the invention and of the method for constructing a riding surface is made to the general part of the description as well as to the appended claims.

It is finally to be expressly pointed out that the aforedescribed exemplary embodiments of the riding surface according to the invention and of the method for constructing a riding surface serve only for discussing the claimed teaching but do not limit said teaching to the exemplary embodiments.

LIST OF REFERENCE SIGNS

1 Tread layer
2 (Lower) mat
3 Drip hoses
4 Grooves
5 Valves
6 Intermediate mat
7 Holes
8 Ground/gravel

What is claimed is:

1. A riding surface comprising:

a sand-based tread layer with damping additives;

a mat which is arranged between the ground and the tread layer, the mat having grooves in a side of the mat that faces the tread layer; and a plurality of drip tubes for watering the tread layer, the drip tubes being located on the side of the mat facing the tread layer and being embedded in the grooves in the mat by way of press-fit;

wherein the grooves in the mat are largely water-impermeable;

wherein the mat further has drain holes which are sized to permit a penetration by water but hinder penetration of comparatively large quantities of sand;

wherein the drain holes are disposed at specific spacings between the drip hoses and the drain holes permit a penetration by water to guarantee dewatering in the event of heavy rain without losing water which emanates from the drip hoses as the grooves and the drain holes are disposed in different depressions of a structure of the mat or are mutually separated by elevations of a net or mesh structure on the side of the mat that faces the tread layer such that the water making its way from the drip hoses does not directly seep away by way of the drain holes but rather makes its way into the tread layer; and wherein the mat is produced from a soft polyurethane foam rubber and/or rubber granulate damping material, and the tread layer is positioned directly on the mat and the drip tubes so that the required volume of the tread layer is minimized with a thickness of a tread layer of 10 to 12 cm, so as to guarantee optimal moistening of the tread layer and a reduced risk of injury to horse and rider.

2. The riding surface as claimed in claim 1, wherein the mat is provided as rolled goods, or as individual mat elements are capable of being snap-fitted to one another.

3. The riding surface as claimed in claim 1, wherein the grooves are machined into the mat or are formed by injection-molding when producing the mat.

4. The riding surface as claimed in claim 1, wherein the drip hoses are formed of plastic.

5. The riding surface as claimed in claim 1, wherein the tread layer comprises sand, aggregates and a geotextile product that bears on the mat and the drip hoses.

* * * * *